US009844488B2

(12) United States Patent
Afshar

(10) Patent No.: US 9,844,488 B2
(45) Date of Patent: Dec. 19, 2017

(54) HIGH FLOW WATER RETURN FITTING FOR SWIMMING POOLS AND SPAS

(71) Applicant: Infusion Pool Products, Inc., Las Vegas, NV (US)

(72) Inventor: Reza Afshar, Westlake Village, CA (US)

( * ) Notice: Subject to any disclaimer, the term of this patent is extended or adjusted under 35 U.S.C. 154(b) by 0 days.

(21) Appl. No.: 14/539,987

(22) Filed: Nov. 12, 2014

(65) Prior Publication Data

US 2017/0239138 A1 Aug. 24, 2017

(51) Int. Cl.

| | |
|---|---|
| ***E04H 4/00*** | (2006.01) |
| ***A61H 33/04*** | (2006.01) |
| ***A61H 33/00*** | (2006.01) |
| ***E04H 4/16*** | (2006.01) |
| ***E04H 4/12*** | (2006.01) |

(52) U.S. Cl.
CPC ..... *A61H 33/6063* (2013.01); *E04H 4/12* (2013.01); *E04H 4/169* (2013.01)

(58) Field of Classification Search
CPC ..... A61H 33/6063
USPC ..... 4/507, 541.6, 492
See application file for complete search history.

(56) References Cited

U.S. PATENT DOCUMENTS 1,973,714 A 9/1934 Justheim
3,166,020 A 1/1965 Cook
4,520,514 A 6/1985 Johnson
4,559,653 A * 12/1985 Mathews ..... A61H 33/6063 239/240
4,717,078 A * 1/1988 Arp ..... B05B 15/08 239/550
4,828,626 A * 5/1989 Meincke ..... E04H 4/12 134/111
4,941,217 A 7/1990 Tobias
5,392,472 A * 2/1995 Maxfield ..... E04H 4/1254 4/490
6,301,723 B1 * 10/2001 Goettl ..... E04H 4/169 239/204
6,578,207 B1 * 6/2003 Fratilla ..... A61H 33/6063 4/492
8,322,908 B1 * 12/2012 Hartmann ..... B01F 5/0212 366/136

(Continued)

*Primary Examiner* — Christine Skubinna
(74) *Attorney, Agent, or Firm* — Louis F. Teran

(57) ABSTRACT

The high flow water return filling of the present invention is designed to connect directly to the end of a water return pipe in a swimming pool, spa, or the like. Water return fittings have been available for many years and have the primary purpose of returning filtered water back into a swimming pool, spa, or the like. However, the water return fitting of the present invention does not only return water into the swimming pool, it also substantially increases the water outflow so that a greater area of water in the pool can be circulated or agitated. In addition, the present invention has a uniquely curved nozzle that does not extend past the face plate, thus, the nozzle does not extend more than one inch from the swimming pool wall. The outflow from the nozzle creates a low pressure condition within the face plate. Thus, the low pressure condition draws water in from the swimming pool through various gaps into the face plate where it is mixed with the outflow of water from the nozzle to increase the total amount of water flowing out of the water return fitting of the present invention.

6 Claims, 9 Drawing Sheets

(56) References Cited

U.S. PATENT DOCUMENTS

| | | | | |
|---|---|---|---|---|
| 8,695,128 | B1 * | 4/2014 | Busbey | A61H 33/6063 4/507 |
| 2004/0255373 | A1 * | 12/2004 | Welden | E04H 4/169 4/507 |
| 2013/0061383 | A1 * | 3/2013 | Hartmann | B01F 5/0212 4/492 |
| 2015/0337553 | A1 * | 11/2015 | Kennedy | A61H 33/6031 4/507 |
| 2016/0083970 | A1 * | 3/2016 | Walsh | E04H 4/1209 4/492 |
| 2016/0121345 | A1 * | 5/2016 | Walsh | E04H 4/169 4/490 |

* cited by examiner

HIGH FLOW WATER RETURN FITTING FOR SWIMMING POOLS AND SPAS

FIELD OF INVENTION

The present invention relates to a water return fitting, and more particularly, for such a fitting as provides a more efficient circulation of return water in swimming pools, spas, and the like. More specifically, the present invention relates to a water return fitting that increases the outflow of return water.

DESCRIPTION OF PRIOR ART

A swimming pool or simply a pool is a container filled with water intended for swimming or water-based recreation. A swimming pool can be built of various sizes and either above or in the ground. A swimming pool may be for public or private use. Private swimming pools are mostly built in private residences and used for recreation and relaxation by adults, children, and even infants. Public pools are mostly built in hotels, schools, fitness centers, and parks. Public pools are mostly used for fitness, water sports, and training by people of all ages, including elderly and young children.

Swimming pools are designed to be large containers of water with a drain, return fittings, and a water recirculation system. The water recirculation system is driven by a large water pump that extracts water from the pool through the drain. The water that is extracted from the pool is passed through a debris collection trap and a skimmer to remove large debris such as leaves and branches. The water is then pumped into a large filter to remove other contaminants. Finally the filtered water is pumped back into the swimming pool through the return fittings that are typically located around the interior wall of the pool.

An average-sized swimming pool will have 4-6 conventional return fittings located 9-14 inches below the water surface. A conventional return fitting provides an outflow of the filtered water in a direction that is parallel to the water surface. Furthermore, the rate of the outflow is enough to circulate 1-18 inches of water depth in a 6 foot deep swimming pool. The remaining 4-5 feet of water in the swimming pool is "dead" in terms of circulation.

The primary objective of a return fitting is not related to "dead" water, instead it is to facilitate the outflow of filtered water into the swimming pool. Problems with "dead" water are typically addressed with other devices rather than the return fitting of the swimming pool. However, return fittings have been invented that facilitate the outflow of filtered water and improve the circulation of the water in a swimming pool, thus reducing the amount of "dead" water. Improved circulation of the water in a swimming pool has a number of advantages including the improvement of water quality, more stable and homogeneous water temperature throughout the pool, elimination of algae build-up, and other. In fact, improved circulation of water can substantially reduce the amount of time required to heat the pool. Improved circulation also reduces the amount of time required to clean the pool water by a cleaning system while reducing hours of pump operation. The circulation prevents the dirt and contaminants in the water to settle on a surface. Finally, better circulation allows the water cleaning chemicals to be better distributed and saturated within the water.

One of the return fittings invented to improve the circulation of the water is disclosed in U.S. Pat. No. 4,520,514 ("the '514 Patent"). The '514 Patent discloses a return fitting with a spherical nozzle that can be rotated to control the direction of the water outflow so as to control the circulation of the water surface. In addition, the return fitting, disclosed by the '514 Patent has a slot in the bottom of the nozzle for downward circulation or agitation of the water below. As such, the '514 Patent serves not just to provide an outflow of filtered water into the swimming pool, it directs the outflow to the water surface and below the surface to improve the circulation of water within a greater area compared to a typical return fittings.

Similarly, U.S. Pat. No. 6,578,207 ("the '207 Patent") discloses a return fitting that uses a spherical nozzle with a plurality of openings to selectively direct jets of water for better control of the circulation patterns of the pool water. The return fitting taught by the '207 Patent allows for the customization of water directional flow. With such directional control of the outflow, the circulation of the pool water is improved without compromising the return fitting's primary objective of returning filtered water into the swimming pool.

On the other hand, U.S. Pat. No. 4,941,217 ("the '217 Patent") discloses a return fitting that improves the circulation of the swimming pool water by increasing the outflow rate. The '217 Patent creates a low pressure condition within a mixing chamber through which the outflow passes. The low pressure condition draws water from a secondary source and mixes it with the main outflow within the mixing chamber. The combined streams then exit the return fitting together so as to increase the discharge flow rate.

The '217 Patent utilizes a nozzle throat designed to increase the velocity of the water being discharged and thereby create a low pressure condition within the mixing chamber. This low pressure condition, in turn, causes a "jet pump" effect. However, the design of the nozzle throat used by the '217 Patent is not unique, it is a conventional venturi nozzle. The design and use of venturi nozzles is not new, they have been previously disclosed by U.S. Pat. Nos. 1,973,714 and 3,166,020. However, it must be noted that although the nozzle used by the '217 Patent increases the flow rate, the outflow is still directed parallel to the surface of the water, thus limiting circulation to the top part of the swimming pool while neglecting the bottom. Additionally, the nozzle used by the '217 Patent protrudes a distance from the pool wall that creates a safety hazard for swimmers.

In most commercial swimming pools, a water return fitting that protrudes more than one inch from the pool wall tends to create a safety hazard for swimmers and expose the owner to liability.

What is needed is a return fitting that will substantially improve the circulation of the water inside a swimming pool by increasing the outflow rate and allowing for directional control of the outflow without allowing the return fitting to protrude far enough from the pool wall to introduce a safety hazard to the swimmers. Unless this and other practical problems associated with swimming pool return fittings are resolved, the problem of not effectively circulating the pool water will persist and an effective return fitting will fail to be realized.

SUMMARY OF THE INVENTION

Accordingly, the present invention has been made in view of the above-mentioned disadvantages occurring in the prior art. The present invention is a water return fitting that connects to the end of a water return line in a swimming pool, spa, or the like and through which filtered water is pumped back into the swimming pool, spa, or the like. A unique nozzle operates in conjunction with a face plate and various gaps to increase the outflow of water into the swimming pool, spa, or the like.

It is therefore a primary objective of the present invention to provide a water return fitting that increases the outflow rate of water into a swimming pool, spa, or the like such that the area of water agitated by the outflow is broader than that with a traditional water return fitting.

Another object of the present invention is to provide a water return fitting with a nozzle that does not extend past the face plate, thus less than one inch from the swimming pool wall.

Yet another object of the present invention is to provide a water return fitting with a nozzle that can rotate 360 degrees.

Yet another object of the present invention is to provide a water return fitting that is easy to install into the end of a water return line and is manufactured out of plastic material to reduce cost and eliminate risk of corrosion.

Yet another object of the present invention is to provide a water return fitting with multiple parts that can be easily assembled correctly without the need of special tools or equipment.

The above objects and other features of the present invention, as well as the structure and operation of various embodiments of the present invention, are described in detail below and with reference to the accompanying drawings.

DESCRIPTION OF THE DRAWINGS

The accompanying drawings which are incorporated by reference herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
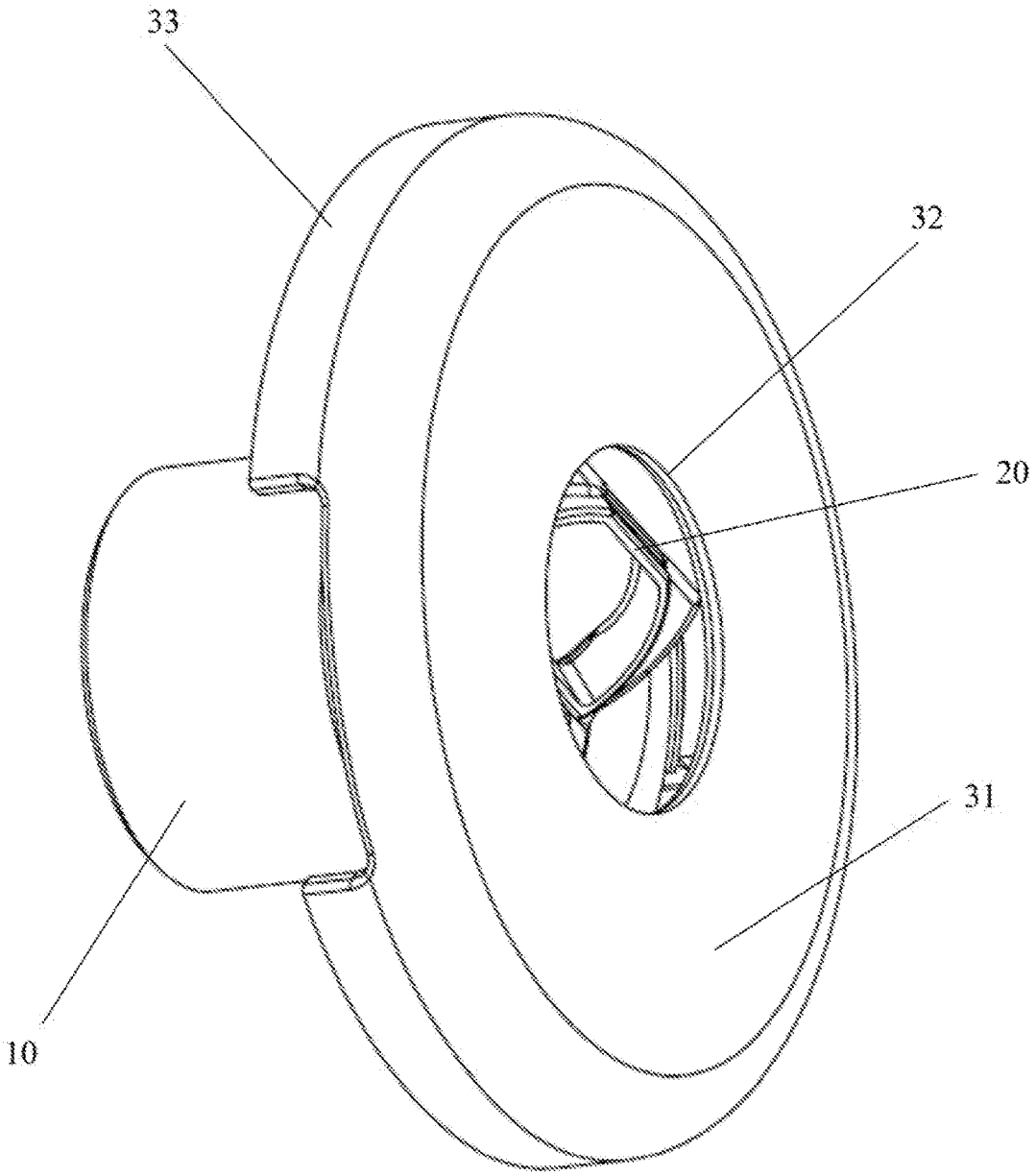
FIG. 1 is a perspective view of the high flow water return fitting of the present invention in its assembled state as it would be installed into a water return line of a swimming pool or spa.

Reference will now be made to the drawings in which various elements of the present invention will be given numerical designations and in which the invention will be discussed so as to enable one skilled in the art to make and use the present invention.

The present invention comprises a water return fitting 100 that attaches to the end of a water return line 200 in a swimming pool or spa and having a pipe connector 10, a nozzle 20, and a face plate 30. It is well known that a typical swimming pool or spa has multiple return lines 200 that are in fluid communication with a filter and a pump that are the main components of a water recirculation system. The pump sucks or draws water from the bottom of the swimming pool and directs it through the filter for removal of unwanted contaminants. After the water is filtered, it is directed back into the swimming pool through various return lines 200. The ends of the return lines are typically located around the interior wall of the pool or spa and within the top section near the water surface. Thus, the outflow of filtered water into the swimming pool or spa is typically near the water surface. The return fitting 100 of the present invention broadens the area of the outflow of filtered water by providing directional control and by increasing the amount of water outflowing into the swimming pool or spa.

Figure 2:
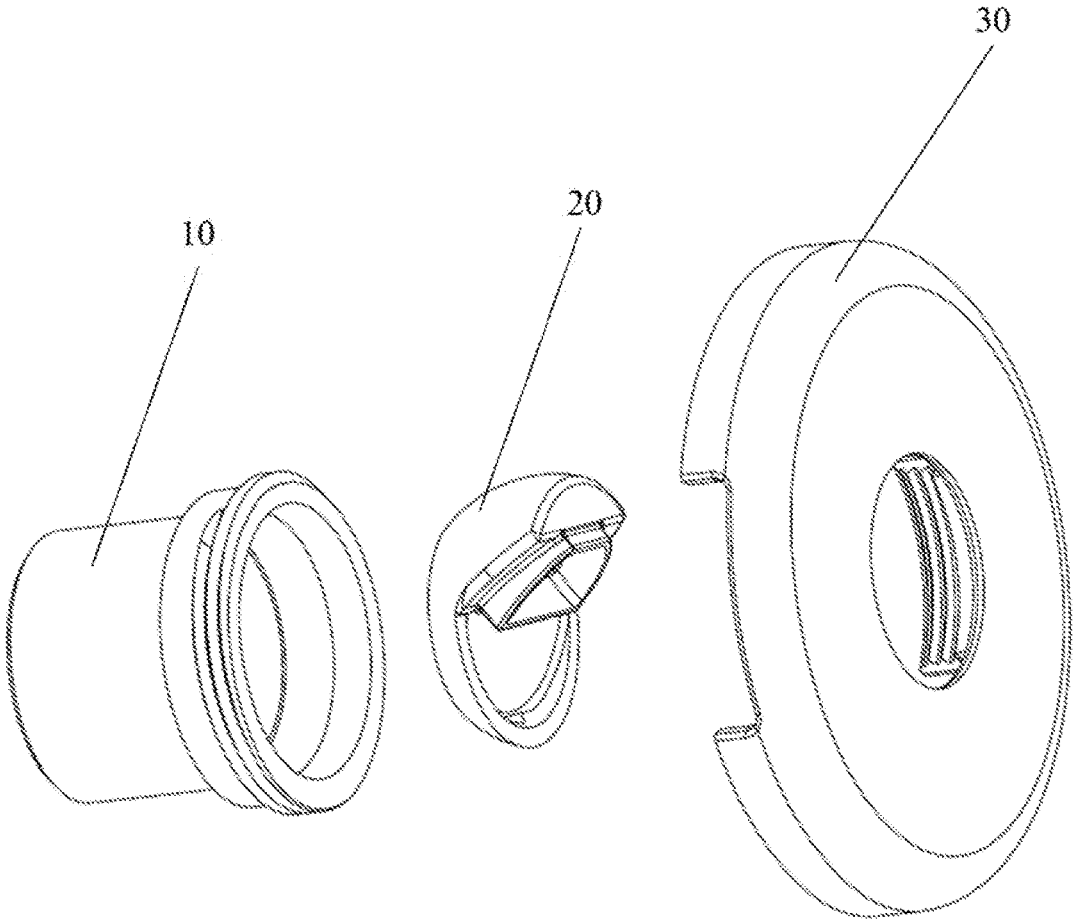
FIG. 2 is an exploded view of the return fitting of the present invention.

FIG. 1 shows a perspective view of the return fitting 100 of the present invention in its assembled state as it would be installed into the end of a water return line 200. FIG. 2 shows an exploded view of the return fitting 100 of the present invention to depict in greater detail the various components that comprise the return fitting 100.

Figure 3:
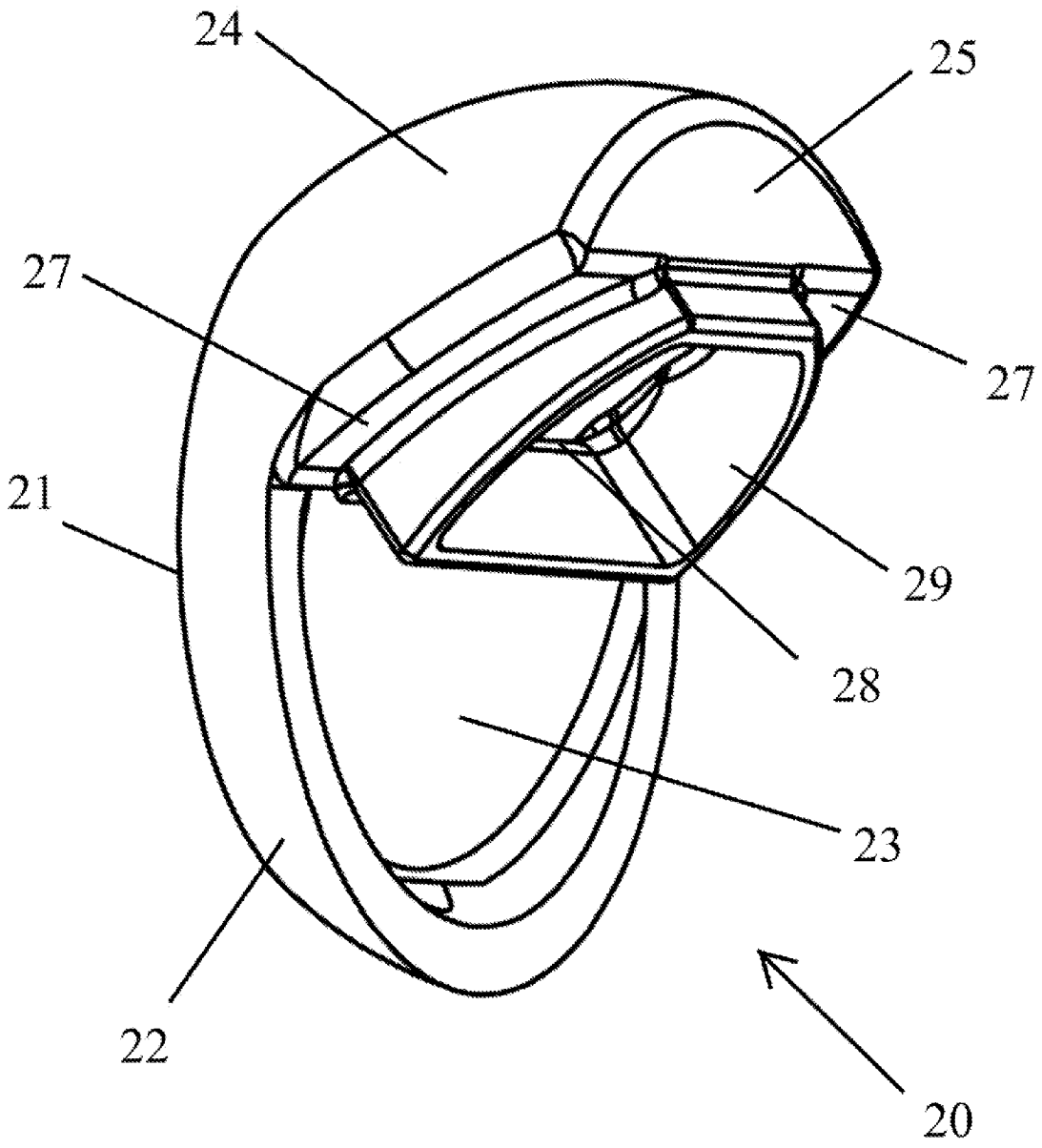
FIG. 3 is a perspective view of the nozzle of the present invention.
Figure 4:
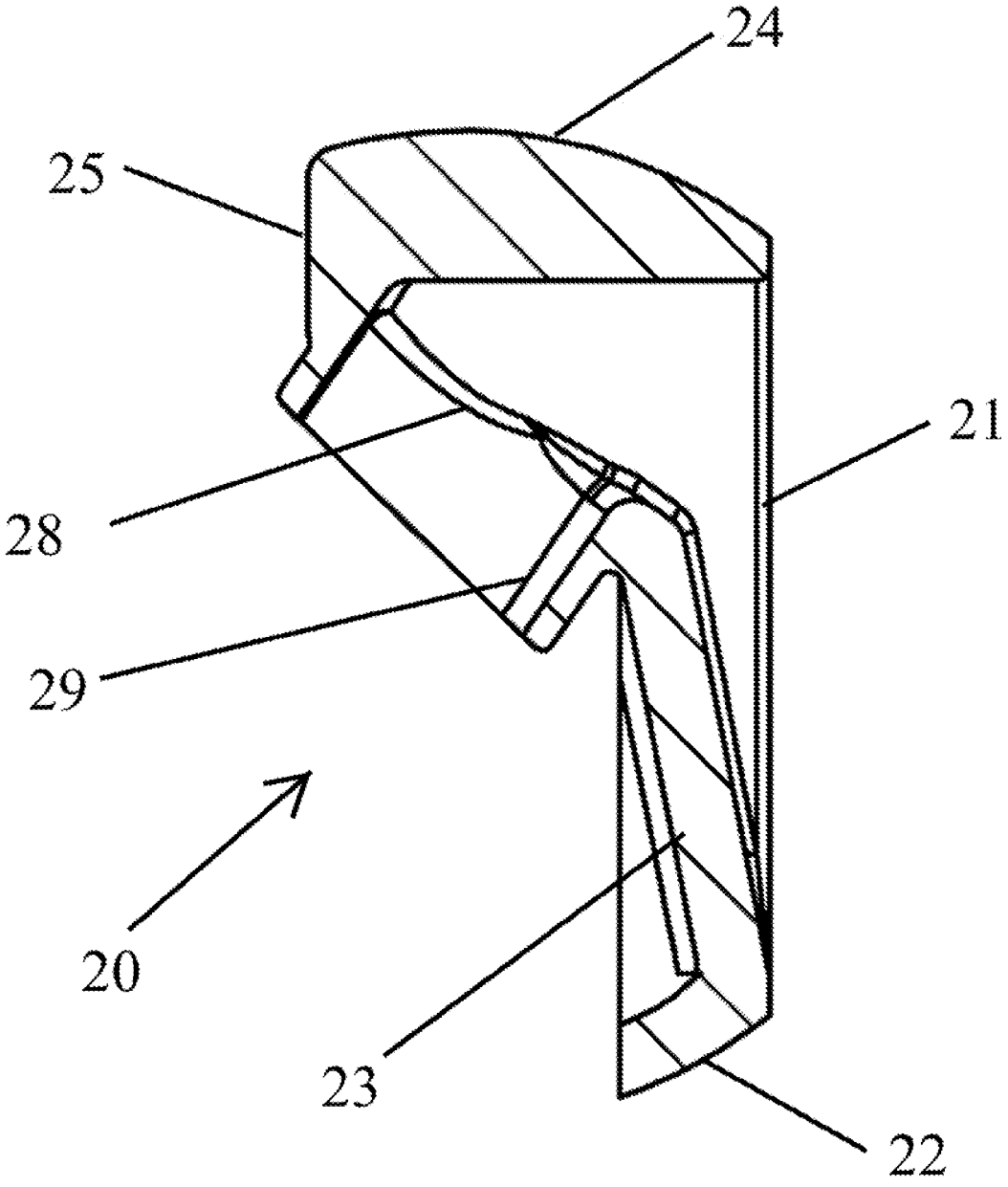
FIG. 4 is a sectional view of the nozzle of the present invention.

As shown in FIG. 3, the nozzle 20 has a rear element that is circular in shape with a rear open end 21 and a perimeter 22 formed by a contoured outer surface. Within the bottom half of nozzle 20, the contoured perimeter 22 extends around a flat plate 23 that leans forward in an acute angle relative to the vertical with the bottom edge behind the top edge, as shown in FIG. 4. On the other hand, the contoured surface of the top half 24 of the nozzle 20 extends forward and terminates at a flat front face 25. The interior surface of the contoured surface of the top half 24 forms a flat and horizontal top wall 26.

An outlet surface 27 is formed by the top edge of the flat plate 23, the bottom edge of the flat front face 25, and the side edges of the contoured surface of the top half 24 of the nozzle 20. The outlet surface 27 is acutely angled relative to the horizontal as shown in FIGS. 3 and 4. An outlet hole 28 is located on the outlet surface 27. The perimeter of the outlet hole 28 extends from the outlet surface 27 in a downward perpendicular direction thereto so as to form an outlet wall 29.

Figure 5:
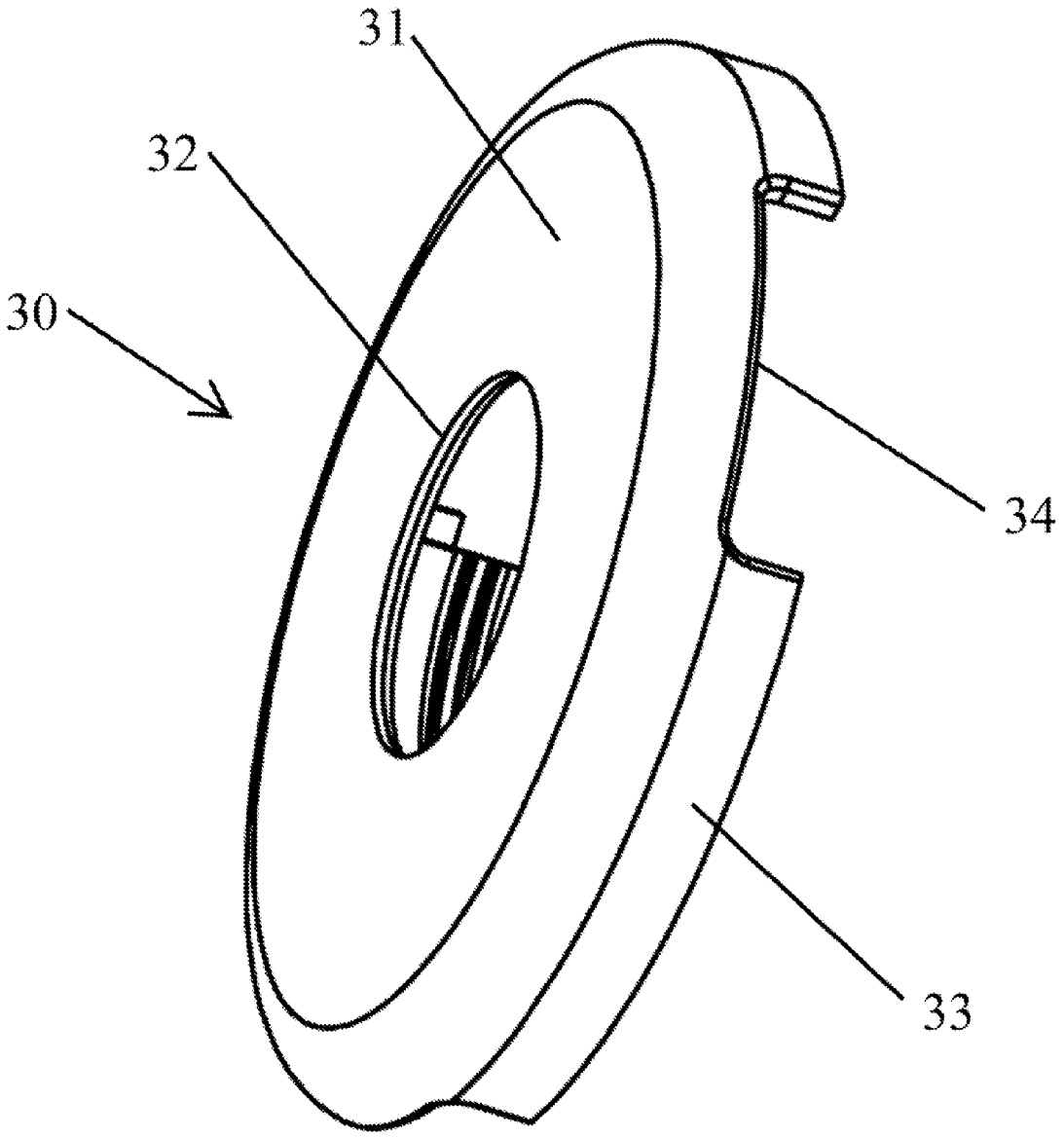
FIG. 5 is a front perspective view of the face plate of the present invention.
Figure 6:
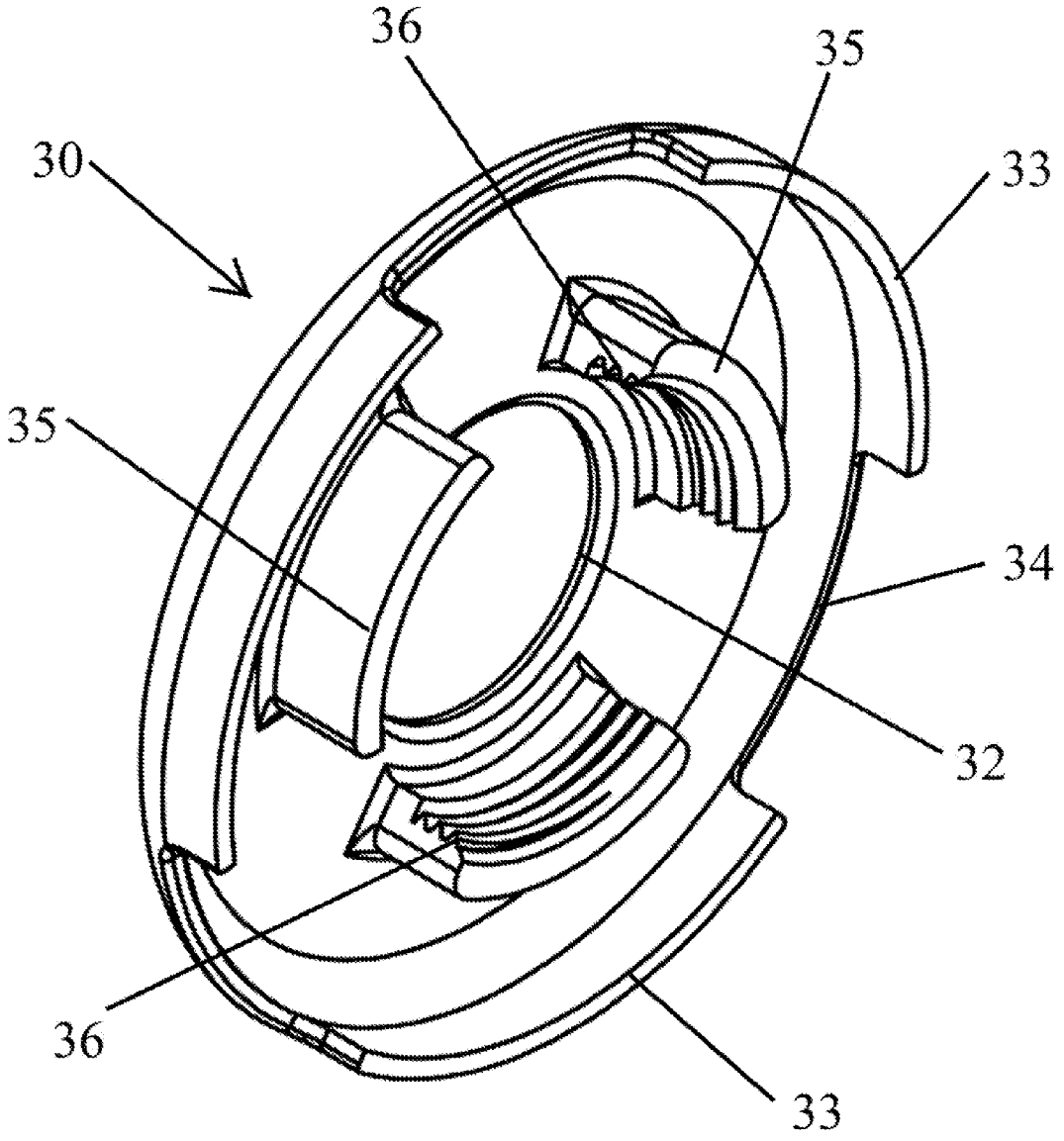
FIG. 6 is a rear perspective view of the face plate of the present invention.

As shown in FIG. 5, the face plate 30 is circular in shape with a flat front plate 31 and a centrally located hole 32. A plurality of sidewalls 33 extend from the perimeter of the flat front plate 31 in a rearward direction. The sidewalls 33 are each separated by side gaps 34. A plurality of threaded extensions 35 extend from the flat front plate 31 in a rearward direction around the hole 32. The threaded extensions 35 have threads 36 molded on the radially interior surface. The threaded extensions are each separated by interior gaps 37. Each interior gap 37 is configured to align with a side gap 34, as shown in FIG. 6.

Figure 7:
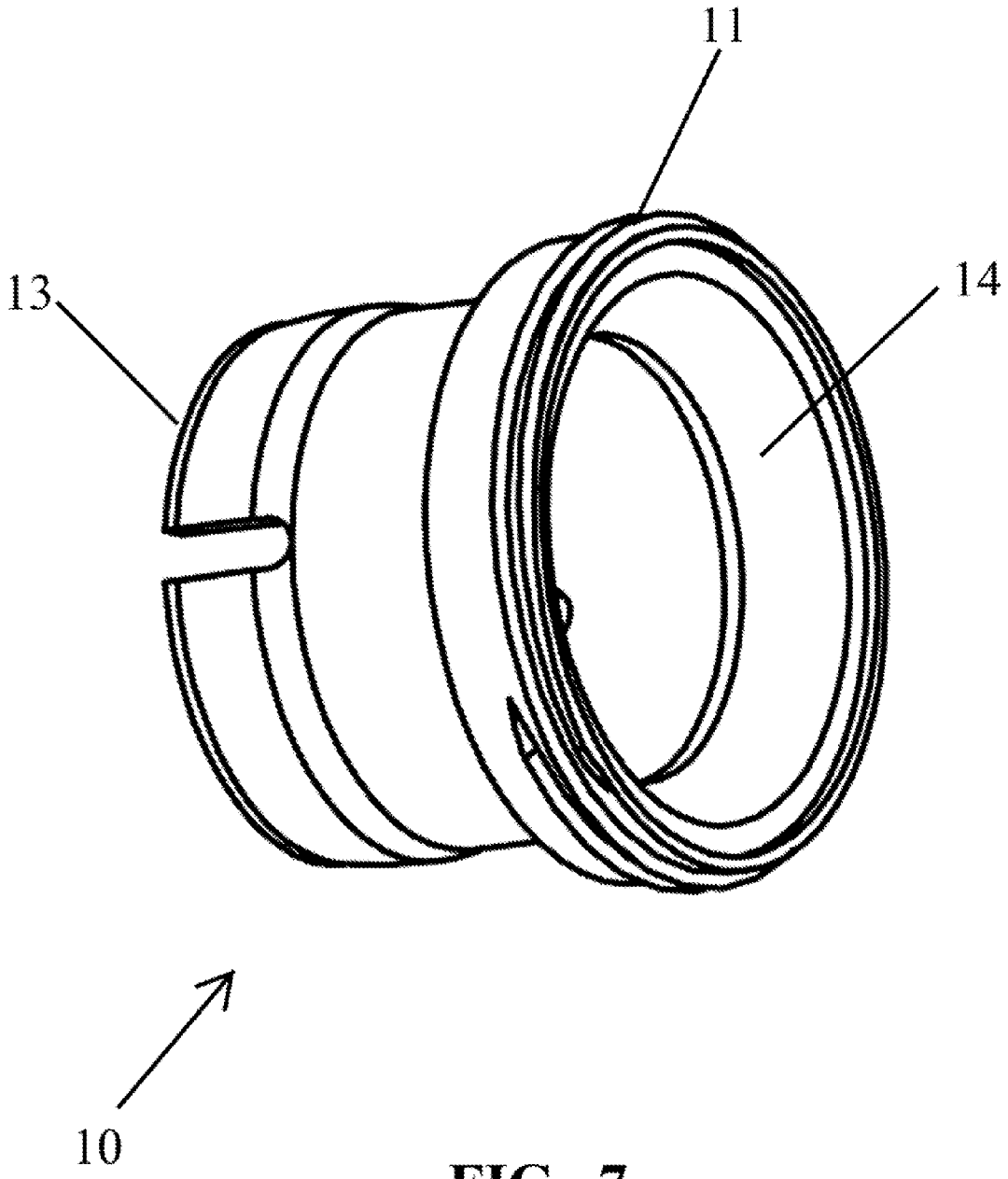
FIG. 7 is a perspective view of the pipe connector of the present invention.
Figure 8:
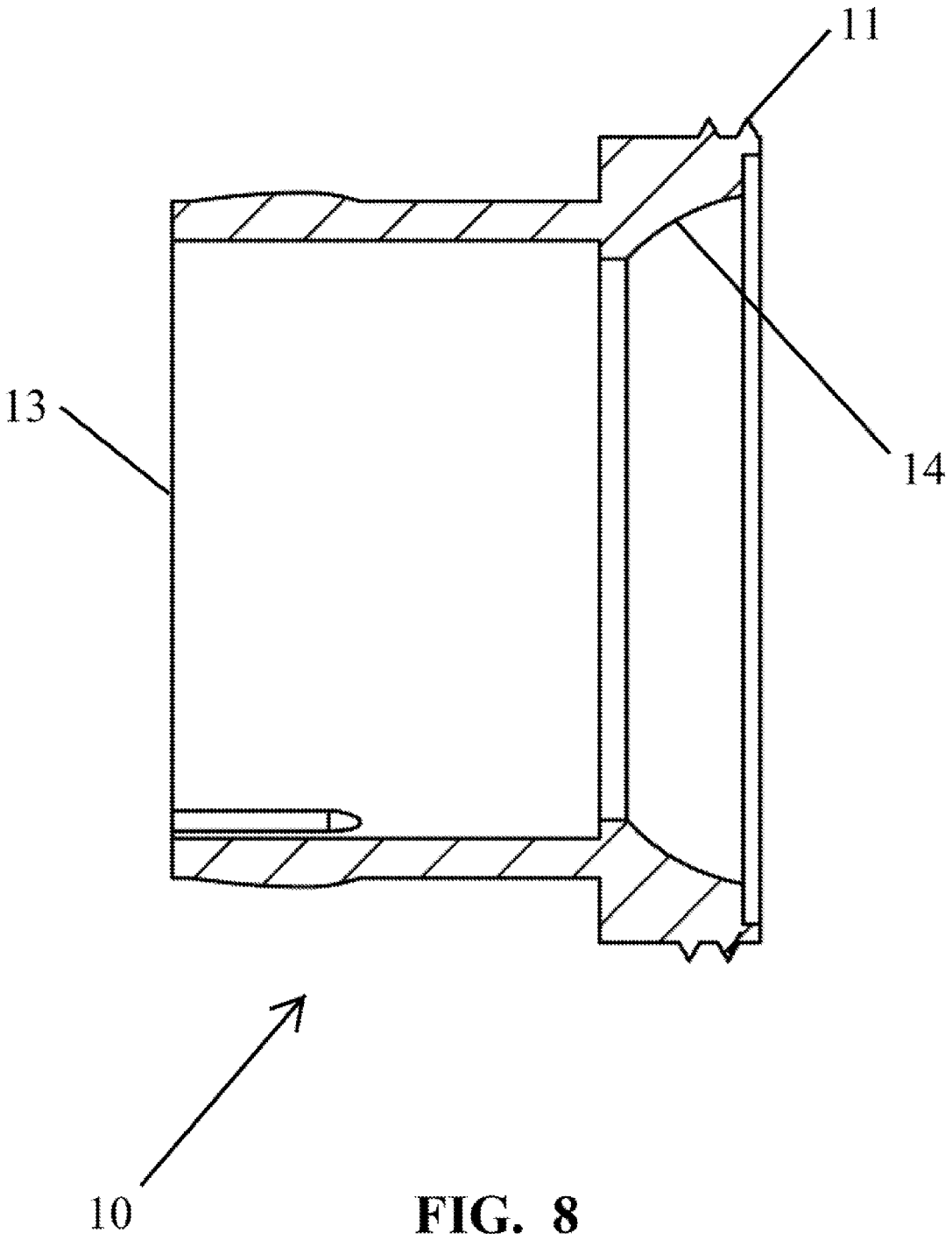
FIG. 8 is a sectional view of the pipe connector of the present invention.
Figure 9:
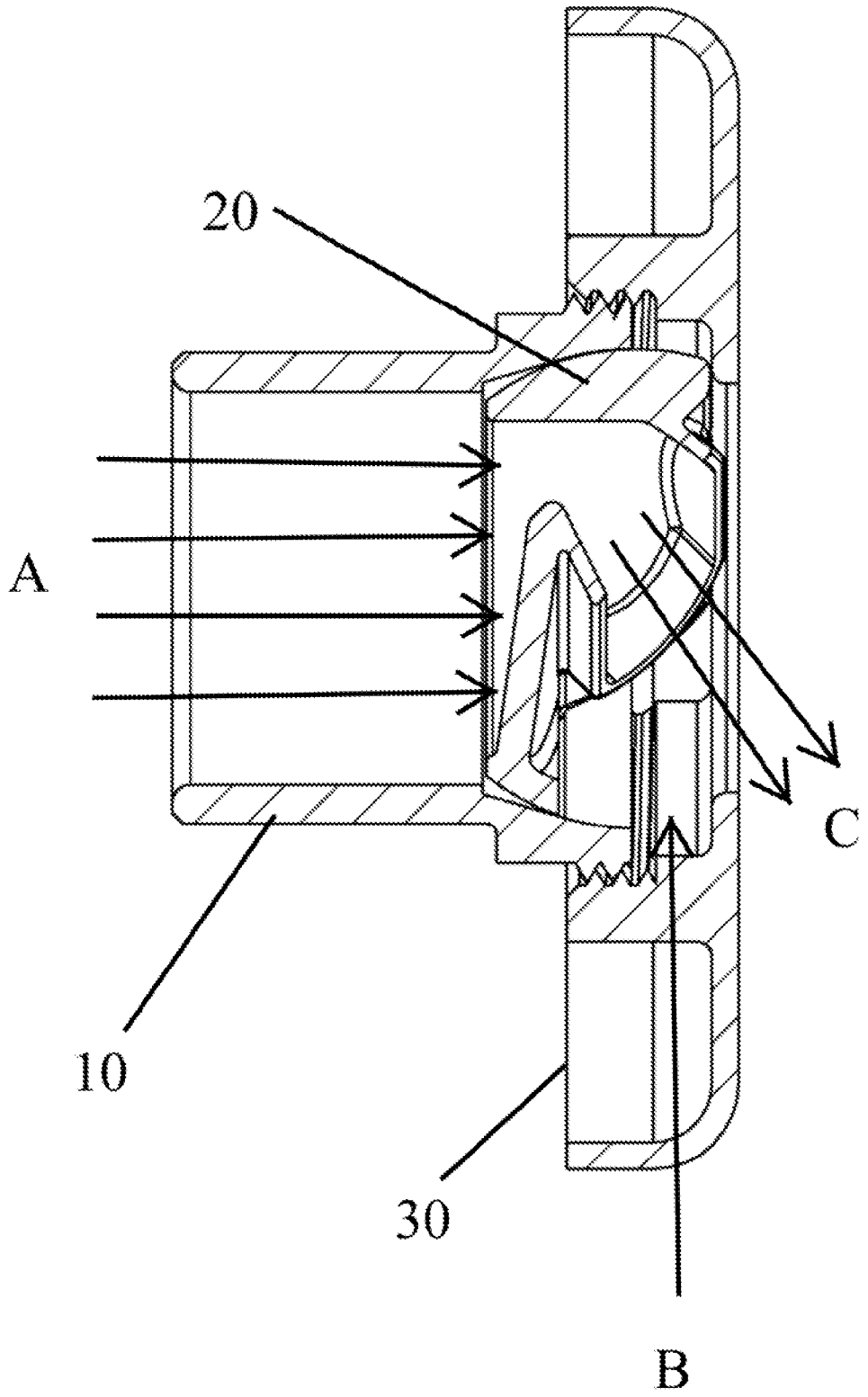
FIG. 9 is a sectional view of the return fitting of the present invention with arrows indicating the direction of the primary and secondary water flow.

As shown in FIGS. 7 and 8, the pipe connector 10 is a tubular part having from outward protruding or male threads 11 in the front end and rear outward protruding or male threads 12 in the back end. The pipe connector 10 also has a rear open end 13 that is in fluid communication with the return line 200 when it is properly installed in a swimming pool. The interior surface 14 in the front end of the pipe connector 10 is contoured so as to physically match or mate with the contoured perimeter 22 of the nozzle 20, as shown in FIG. 9.

Hereinafter, an explanation on the methods of assembling the product of the present invention, the installation thereof to a water return line 200 and the operating states thereof will be given.

For the assembly of the return fitting 100 of the present invention, the contoured perimeter 22 of the nozzle 20 is physically matched or mated with the interior contoured surface 14 in the front end of the pipe connector 10. Then the threads 36 of the threaded extensions 35 of the face plate 30 are physically mated or matched with the male threads 11 in the front end of the pipe connector 10. This physically attaches the face plate 30 to the pipe connector 10 while the nozzle 20 is sandwiched in between the face plate 30 and the pipe connector 10. Since the nozzle 20 is not physically attached to the pipe connector 10, the contoured perimeter 22 and the interior contoured surface 14 allows the nozzle 20 to rotate and/or swivel within the pipe connector 10.

Furthermore, after attaching the face plate 30 to the pipe connector 10, the face plate 30 must be rotated so as to align the interior gaps 37 with the side gaps 34. Finally, an o-ring or a gasket 39 is placed in between the face plate 30 and the pipe connector 10 so as to prevent water leakage therefrom.

The assembly of the return fitting 100 of the present invention as discussed above is expected to be completed by the manufacturer prior to the distribution or sale thereof to a consumer. On the other hand, installation of the return fitting 100 of the present invention simply requires the replacement of a conventional return fitting with the return fitting 100 of the present invention. In essence, the return fitting 100 of the present invention is attached to the end of a water return line 200 in a swimming pool or spa. This attachment is accomplished by screwing or threading the return fitting 100 to a water return line 200 using the rear outward protruding or male threads 12 in the back end of the male threaded connector 10. A solvent or rubber gasket may be used to prevent water leakage from this connection. Thus, the installation of the product of the present invention is simple enough for a typical consumer to complete without the aid of special tools or a professional.

When the return fitting 100 of the present invention is connected to a return line 200 of a swimming pool, the pump in the swimming pool's recirculation system pumps filtered water through the return line 200 horizontally and into the rear open end 13 of the pipe connector 10. Thereafter, some of the flow of filtered water collides against the acutely angled flat plate 23 of the nozzle 20 (as shown by arrows "A" in FIG. 10). Thus, the collision interrupts the flow of the filtered water and facilitates the accumulation of filtered water within the nozzle 20 that results in raising the pressure within the nozzle 20. The raised pressure within the nozzle 20 then pushes the filtered water through the outlet hole 28 of the nozzle 20 at a higher flow rate than a conventional return fitting. Conventional return fittings do not have the acutely angled flat plate 23 that facilitates the accumulation of water within the nozzle. The rate of filtered water flowing out of the outlet hole 28 is dependent on the size of the outlet hole 28 and the size of the acutely angled flat plate 23. A smaller outlet hole 28 and a larger acutely angled flat plate 23 increases the amount of water accumulation within the nozzle 20, thus, resulting in a higher pressure that pushes the filtered water through the outlet hole 28 at a higher rate or velocity.

The filtered water flowing out of the outlet hole 28 of the nozzle 20 at a high velocity creates a low pressure condition within the face plate 30. This low pressure condition, in turn, causes a "jet pump" effect which results in a secondary stream of water being sucked into the face plate 30 from the swimming pool through the side gaps 34 and interior gaps 37 (as shown by arrows "B" in FIG. 10). The resulting combined stream of water, which is the sum of the primary and secondary streams, flows through the hole 32 of the face plate 30 (as shown by arrows "C" in FIG. 10).

By combining the primary and secondary streams in the manner described above, the flow rate of the filtered water exiting from the return fitting 100 of the present invention is increased without increasing the capacity of the pump employed to supply the primary stream of water into the return fitting 100. Such increased flow rates result in improved agitation of the water contained in the swimming pool or spa. First, the increased flow rate of water out lowing from the return fitting 100 of the present invention allows a greater volume of water in the pool or spa to be agitated since the stream of the outflowing water extends a greater distance than the outflow from a conventional return fitting. Secondly as the direction of the stream of outflowing water is acutely angled downward relative to the horizontal, the volume of pool or spa water above the return fitting 100 is agitated by the suctioning effect or drawing of water through the side gaps 34. As such, a greater volume of water in the pool or spa is agitated by the return fitting 100 of the present invention than by a conventional return fitting. The return fitting 100 of the present invention circulates or agitates water above and below it.

As discussed above, the nozzle 20 is not rigidly attached within the return fitting 100. Instead, its mere abutment of the contoured perimeter 22 and the interior contoured surface 14 allows the nozzle 20 to rotate and/or swivel within the pipe connector 10. In other words, when the return fitting 100 is installed to the end of a water return line 200, the nozzle 20 can be rotated a full 360 degrees to direct the direction of the outflow of filtered water into the swimming pool.

The rotatability of the nozzle 20 allows the return fitting 100 to operate in one of three primary positional modes. In the fountain mode, the nozzle 20 is aimed upward 11 this mode, the water becomes very choppy, thereby creating a heavy water flowing sound. This mode prevents the sun from penetrating the water surface and heating the water in hotter climates.

In the river mode, the nozzle 20 is aimed to the side and aims the outflow of water across the suffice of the pool or spa. In this mode, the outflowing water creates a soothing sound and helps sweep leaves and debris toward the skimmer.

In the energy efficient mode, the nozzle 20 is aimed downward toward the pool floor. This moves warn water toward the bottom of the pool or spa and also forces the warm water created by gas or electric heaters, solar blankets, pool covers, and solar panels to the floor of the pool, providing for a more consistent temperature throughout the pool or spa.

Finally, although the return fitting 100 of the present invention uses side gaps 34 and interior gaps 37, it will be appreciated by those skilled in the art that the principles of this invention may be accomplished using holes or slits.

It is understood that the described embodiments of the present invention discussed above are illustrative only, and that modifications thereof may occur to those skilled in the art. Accordingly, this invention is not to be regarded as limited to the embodiments disclosed, but to be limited only as defined by the appended claims herein.

What is claimed is:

1. A water return fitting that connects to a water return line of a swimming pool, or spa and comprising:

a nozzle having a circular perimeter, a contoured outer surface along said perimeter, a top half, and a bottom half;

wherein said bottom half is formed by a flat plate that is acutely angled relative to the vertical and said top half extends forward and terminated at a flat front face;

an outlet surface formed by a top edge of said flat plate, a bottom edge of said flat front face, and a first and second side edges of said top half;

an outlet hole on said outlet surface having a perimeter along which an outlet wall extends;

a face plate having a hole, a perimeter, a plurality of sidewalls that extend along said perimeter, a plurality of side gaps that separate each of said sidewalls, a plurality of extensions, and a plurality of interior gaps that separate each of said extensions;

a pipe connector having a front end and a back end and that is in fluid communication with said water return line;

wherein an interior surface of said front end is contoured to match said contoured outer surface of said nozzle;

wherein said nozzle is inserted into said front end of said pipe connector such that said interior surface abuts said contoured outer surface and wherein said face plate is attached to said pipe connector so as to retain said nozzle;

whereby water from said water return line flows through said pipe connector then collides with said flat plate of said nozzle such that said water accumulates within said nozzle until said water is pushed through said outlet hole of said nozzle and flows out through said hole of said face plate; and whereby said water pushed out of said outlet hole of said nozzle creates a low pressure condition within said face plate that draws pool water through said side gaps and interior gaps into said face plate.

2. A water return fitting that connects to a water return line of a swimming pool, or spa according to claim 1 wherein said outlet wall of said nozzle does not extend past said hole of said face plate.

3. A water return fitting that connects to a water return line of a swimming pool, or spa according to claim 1 wherein said nozzle is rotatably attached such that said nozzle can rotate relative to said pipe connector.

4. A water return fitting that connects to a water return line of a swimming pool, or spa according to claim 1 wherein said side gaps are located on said sidewalls of said face plate.

5. A water return fitting that connects to a water return line of a swimming pool, or spa according to claim 1 further comprising a plurality of small holes located on said face plate.

6. A water return fitting that connects to a water return line of a swimming pool, or spa according to claim 1 wherein said nozzle, said face plate, and said pipe connector are all made of a plastic material.

* * * * *